US005605302A

United States Patent [19]

Miglietta

[11] Patent Number: 5,605,302

[45] Date of Patent: Feb. 25, 1997

[54] SHAFT FOR SUPPORTING CUT ROLL PORTIONS IN A CUTTING-REELING MACHINE

[75] Inventor: Adelio Miglietta, Villanova Monferrato, Italy

[73] Assignees: Massimo Miglietta; Maurizio Miglietta, both of Villanova Monferrato, Italy

[21] Appl. No.: 538,822

[22] Filed: Oct. 5, 1995

[51] Int. Cl.[6] ..... B65H 75/24

[52] U.S. Cl. ..... 242/571.2

[58] Field of Search ..... 242/530, 530.1, 242/530.3, 530.4, 571.2, 577, 577.1, 577.2, 577.3, 577.4, 578, 378.2; 279/2.05, 2.06, 2.08

[56] References Cited

U.S. PATENT DOCUMENTS

| | | | |
|---|---|---|---|
| 2,625,338 | 1/1953 | McArn . | |
| 3,878,999 | 4/1975 | Daves . | |
| 3,917,187 | 11/1975 | Damour . | |
| 4,218,029 | 8/1980 | Schwenzfeier et al. | 242/530.3 |
| 4,332,356 | 6/1982 | Damour . | |
| 4,342,433 | 8/1982 | Mastriani . | |
| 4,440,356 | 4/1984 | Lang | 242/530 |
| 4,461,430 | 7/1984 | Lever . | |
| 4,611,769 | 9/1986 | Orbach | 242/530.4 |
| 4,693,431 | 9/1987 | Kataoka | 242/530.1 |

FOREIGN PATENT DOCUMENTS

| | | | |
|---|---|---|---|
| 2-231368 | 9/1990 | Japan | 242/530.3 |
| 1079188 | 8/1967 | United Kingdom | 242/530.3 |
| WO8100558 | 3/1981 | WIPO . | |

*Primary Examiner*—John P. Darling

*Attorney, Agent, or Firm*—Sughrue, Mion, Zinn, Macpeak & Seas

[57] ABSTRACT

The shaft for supporting cut roll portions in a cutting-reeling machine includes a cylindrical body, the outer surface of which has at least one recess for housing a resilient envelope which can be connected to a source of fluid under pressure by ducts in the cylindrical body. The shaft includes a plurality of rings open along respective generatrices, disposed side by side around the outer surface of the body and coaxial with the axis of the shaft. The rings have radial edges for engagement with grooves in the body of the shaft which allow them to expand circumferentially as a result of the inflation of the resilient envelope.

6 Claims, 4 Drawing Sheets

SHAFT FOR SUPPORTING CUT ROLL PORTIONS IN A CUTTING-REELING MACHINE

BACKGROUND OF THE INVENTION

The present invention relates to a shaft for supporting cut roll portions in a cutting-reeling machine and to a cutting-reeling machine comprising such a shaft.

The term cutting-reeling machine as used herein means a machine which can unwind a roll of strip material, for example, paper or plastics film, cut it perpendicular to its axis into two or more portions and rewind the cut portions forming rolls of smaller axial length than the starting roll.

The cut portions are usually rewound on a pair of separate shafts so that adjacent portions of the original roll are rewound on different shafts, staggered in a chessboard-type arrangement. In particular, the various portions are rewound on respective tubular cores, usually of cardboard, positioned coaxially around the shafts.

More particularly, the present invention relates to a shaft for supporting cut roll portions, comprising a cylindrical body the outer surface of which has at least one recess for housing a resilient envelope which can be connected to a source of fluid under pressure, for example compressed air, by ducts in the cylindrical body.

According to the prior art, the outer surface of the cylindrical body of such a shaft has a plurality of uniformly-spaced longitudinal circumferential recesses each of which can house a respective resilient envelope which can be inflated as a result of the admission of compressed air to its interior.

The inflation of the envelopes causes their outer surfaces to expand and to be pressed against the inner surfaces of the cardboard cores onto which the cut roll portions are rewound, preventing them from sliding relative to the shaft during the rotary motion thereof.

If the thickness of the material of the original roll is not constant throughout the width of the strip, for example, owing to manufacturing defects, the rewinding of the cut portions causes their radial dimensions to vary relative to one another, naturally being greater for the portions cut from the thicker portions of the original roll.

At the same time, the angular velocity of the rotation of all of the roll portions which are rewound on the same shaft is equal since the direct contact between the inflated envelopes associated with the shaft and the cores of the various cut roll portions prevents any relative sliding.

As a result of this, at a given moment, the tangential winding velocities of the strip material in the various cut roll portions supported by the same shaft may be different. In fact, these tangential velocities result from the product of a constant angular velocity and a radius which may vary as a result of the possible variations in thickness mentioned above.

Different tangential velocities are extremely harmful since they result in different tensions in the various cut portions of strip being rewound. At the least, some of these tensions will in fact differ from the theoretical value causing the rewinding of the cut roll portion concerned to be loose if they are too low, or too tight if they are too high.

SUMMARY OF THE INVENTION

In order to prevent the problem mentioned, the subject of the present invention is a shaft of the type indicated above, characterized in that it comprises a plurality of rings open along respective generatrices, arranged side by side around the outer surface of the cylindrical body and coaxial with the axis of the shaft, the rings having means for engagement with the body of the shaft which allow the rings to expand circumferentially as a result of the inflation of the resilient envelope.

According to the invention, the cores of various cut roll portions disposed around the same shaft do not bear directly on the inflated envelopes but on the outer surfaces of the rings. Moreover, since there is a large number of these, conditions where different cores bear on different portions of the same ring never occur, whereas the same core may bear on several different rings.

As a result, each core is supported by the shaft practically throughout its circumference and substantially independently of the other cores. This permits independent and homogeneous sliding of each core relative to the shaft if the thickness of the strip wound varies in the various cut roll portions.

The tangential velocities of the various cut strip portions which are rewound around the same shaft can thus be kept constant. For example, excessive thickness of the strip in a certain cut strip portion, which involves an inappropriate increase in the radius of the roll being rewound, in fact automatically corresponds to a slowing of its angular velocity due to sliding of the core on the surfaces of the rings so that the product of the two quantities remains constant.

The fact that the tangential rewinding velocity is constant results in the various cut strip portions being subjected to a substantially constant tension which can be made to correspond to the optimal value at any moment.

The material used for forming the rings is preferably a metal, particularly steel, such as to enable the cores which are generally made of cardboard, to slide correctly on the outer surfaces of the rings.

A further subject of the present invention is a cutting-reeling machine comprising at least one shaft of the type indicated above.

BRIEF DESCRIPTION OF THE DRAWINGS

Further advantages and characteristics of the present invention will become clear from the following detailed description given with reference to the appended drawings, provided purely by way of non-limiting example, in which.

DETAILED DESCRIPTION OF THE INVENTION

Figure 1:
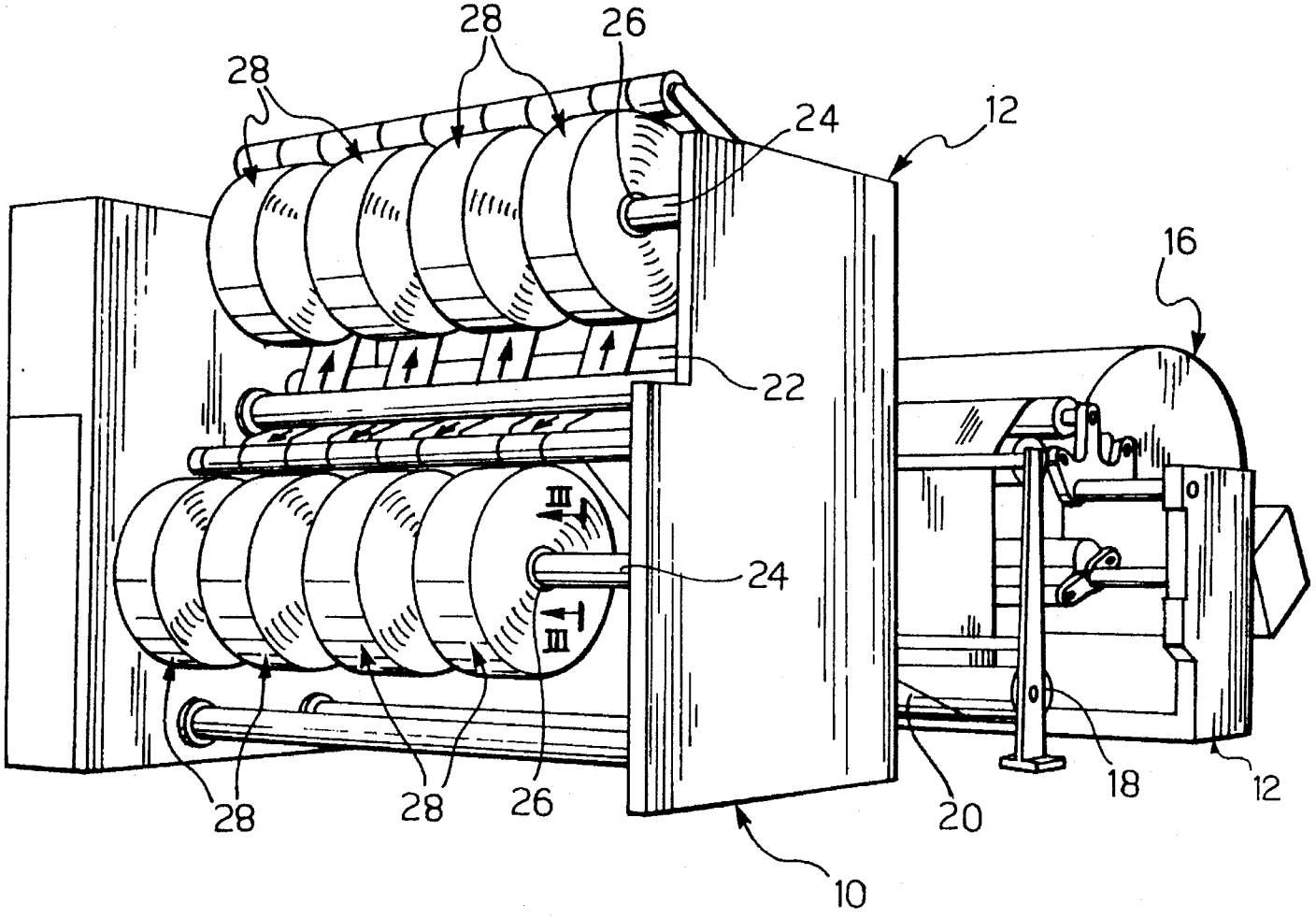
FIG. 1 is a perspective view of a cutting-reeling machine comprising a pair of shafts according to the invention.
Figure 2:
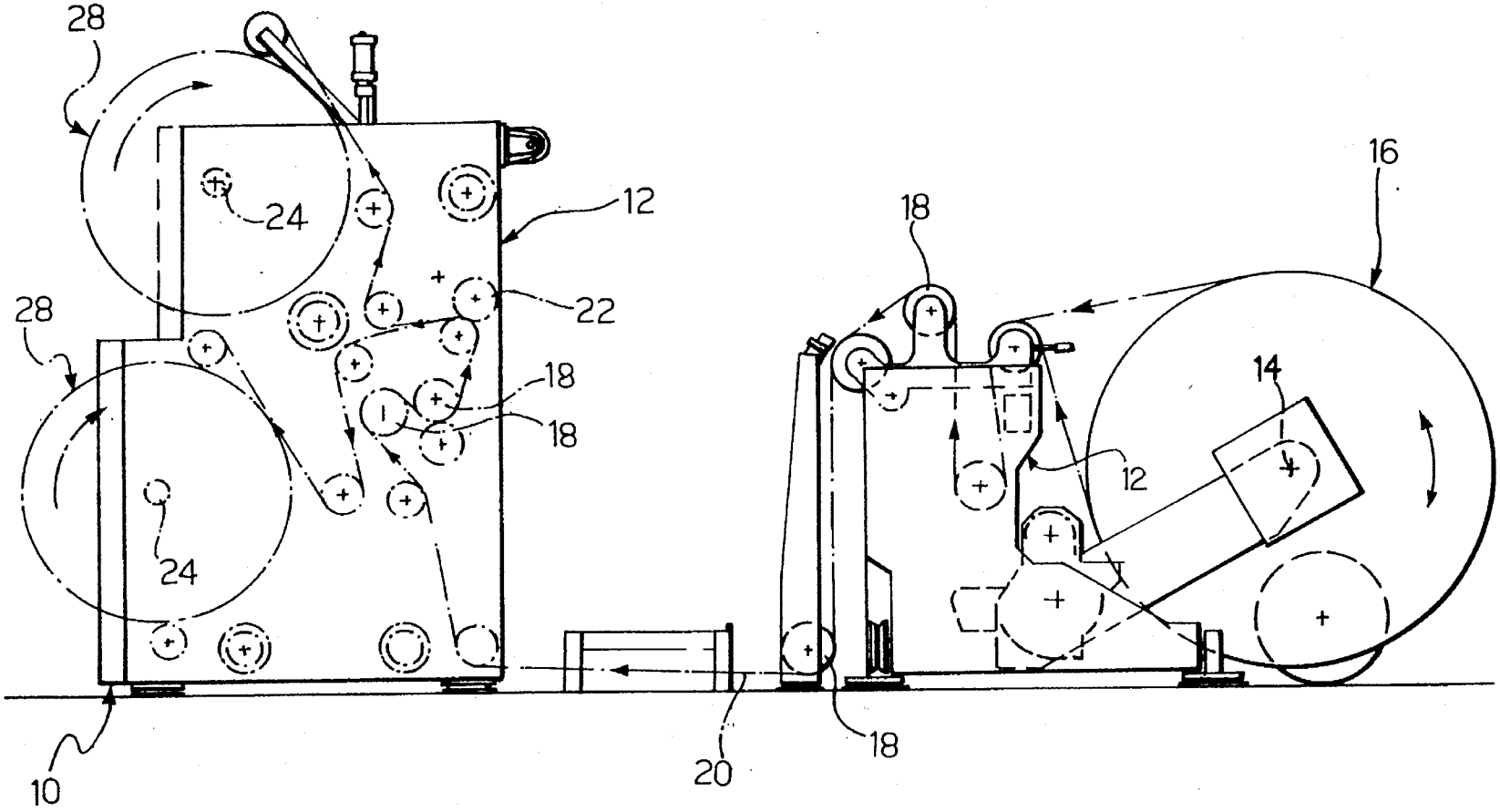
FIG. 2 is a side elevational view of the machine of FIG. 1.

A cutting-reeling machine of known type, described only briefly herein, is indicated 10 in FIGS. 1 and 2.

The machine 10 comprises a support frame 12 on which a first rotatable shaft 14, suitable for supporting a roll 16 of strip material to be unwound, is engaged.

A plurality of transmission rollers 18 for the strip 20 unwound from the roll 16 are also mounted on the frame 12, as well as a cutting shaft 22 which supports a plurality of blades spaced apart longitudinally and not visible in the drawings, for cutting the strip 20 into several portions in a direction parallel to its length and perpendicular to the axes of the first shaft 14 and of the transmission rollers 18.

Finally, two rewinding shafts 24, provided with rotation means, are engaged on the frame 12 and tubular cores 26, generally made of compressed cardboard, are spaced apart longitudinally thereon. A respective portion of cut strip is wound around each core 26 forming a plurality of rolls 28 of smaller axial length than the original roll 16.

Figure 3:
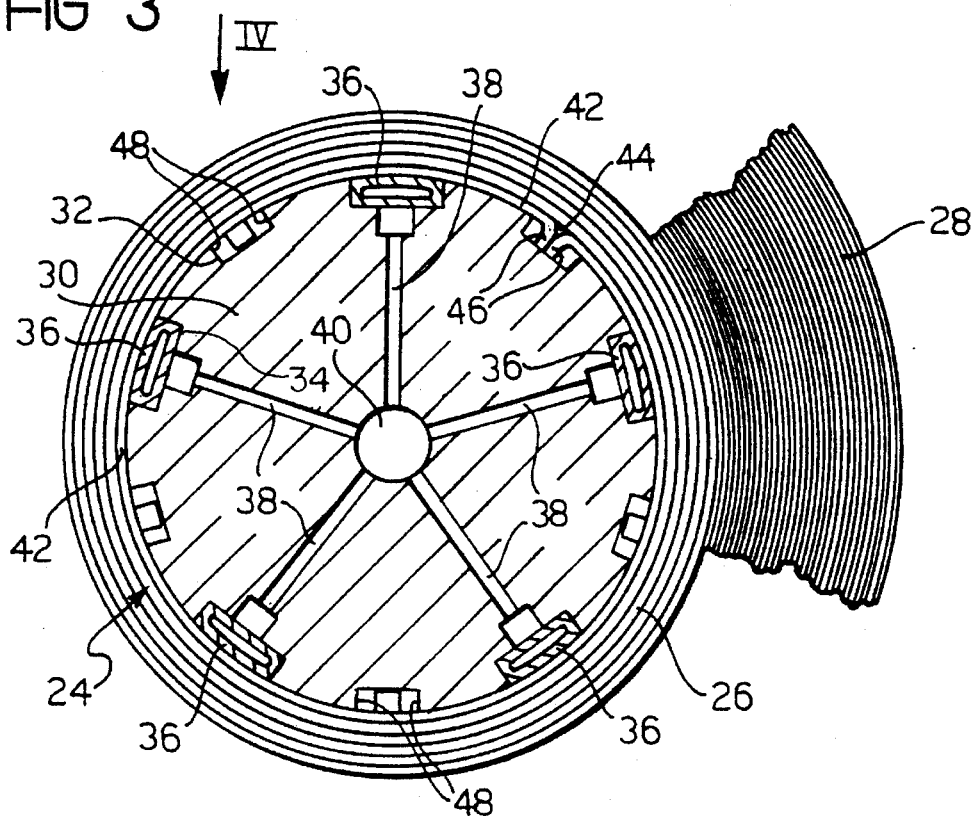
FIG. 3 is a section through one of the shafts taken on the line III—III of FIG. 1.

Each rewinding shaft 24 comprises (FIGS. 3, 4, and 5) a cylindrical body 30 the outer surface of which has a plurality of uniformly-spaced longitudinal grooves 32 of rectangular cross-section alternating with longitudinal recesses 34. Both the grooves 32 and the recesses 34 are straight and parallel to the axis of the shaft 24.

Each recess 34 houses a respective resilient envelope 36 connected by a respective radial duct 38 formed in the cylindrical body 30 to a duct 40 coaxial with the axis of the shaft 24 and connectible to a source of fluid under pressure, for example, compressed air.

Each shaft 24 also comprises a plurality of rings 42, preferably made of a metal such as steel, which are open along respective generatrices 44 and are arranged side by side around the outer surface of the cylindrical body 30 and coaxial with the axis of the shaft 24.

Each ring 42 has edges 46 turned over radially towards the axis of the shaft 24 along the open generatrix 44 for engaging with clearance in one of the grooves 32 in the outer surface of the cylindrical body 30.

When the machine 10 is in operation (FIGS. 1 and 2), the strip 20 which is gradually unwound from the roll 16 is cut perpendicular to the axis of the roll 16 into several portions by blades mounted on the shaft 22.

The cut portions of the strip 20 then form the rolls 28 as a result of being rewound around respective cores 26 positioned on one of the shafts 24 which are rotated about their own axes.

The cores 26 are arranged on the two rewinding shafts 24 in a chessboard-type arrangement so that adjacent portions of strip 20 of the original roll 16 are wound on different shafts 24.

Engagement between the cores 26 and the respective shaft 24 is achieved as a result of the inflation of the envelopes 36 by means of compressed air which is made to flow through the ducts 38, 40 (FIG. 3) and causes the rings 42 to expand circumferentially and to be pressed against the inner surfaces of the cores 26. This expansion is opposed by the stiffness of the cores 26 and is limited to a maximum value determined by the widths of the grooves 32 of which the radially extending walls 48 are finally in abutment with the turned over edges 46 of the open generatrices 44 of the rings 42.

The turned over edges 46 may be inserted in any one of the grooves 32. As can be seen from FIG. 4, it is convenient to insert the edges 46 of adjacent rings 42 in different grooves 32.

Figure 4:
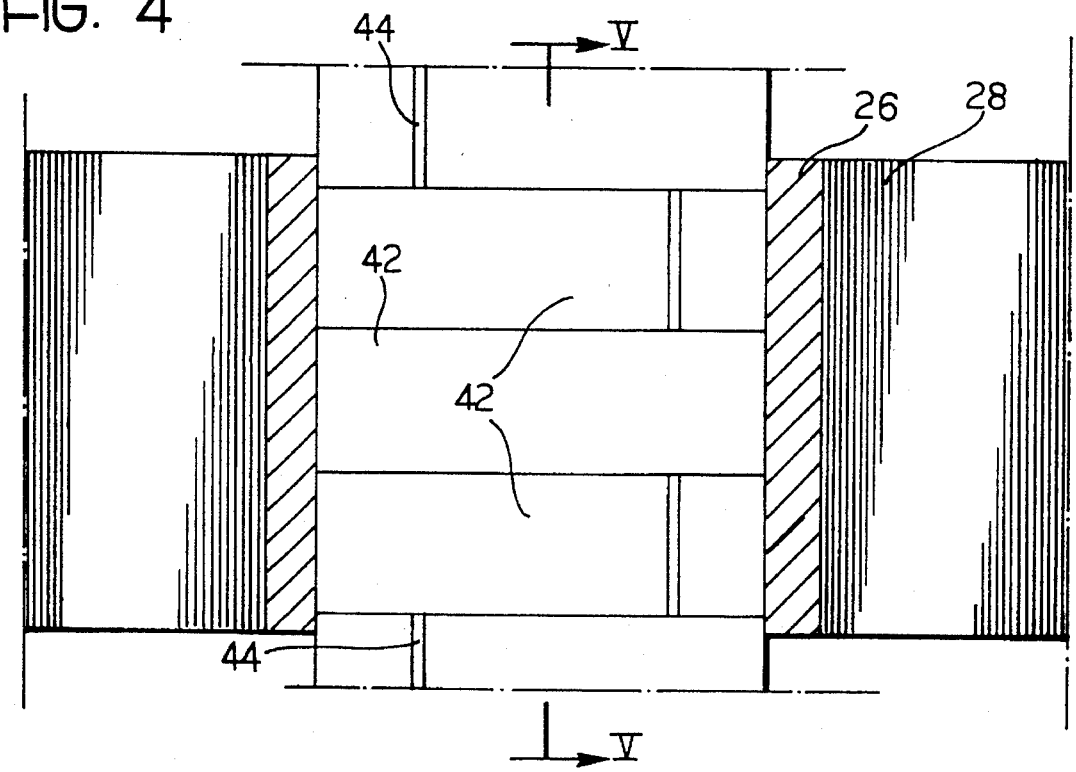
FIG. 4 is a plan view of the shaft of FIG. 3.
Figure 5:
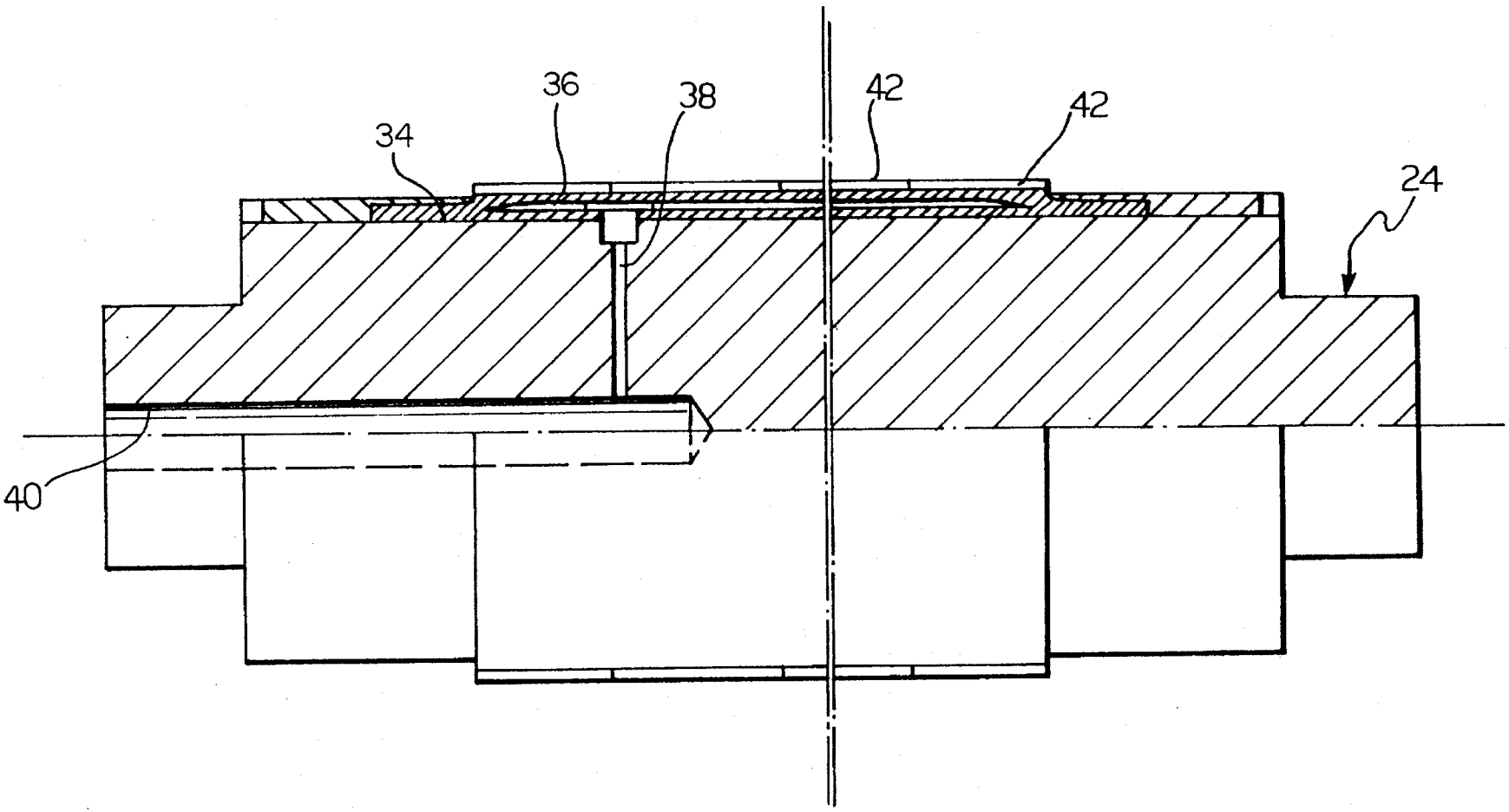
FIG. 5 is a section taken on the line V—V of FIG. 4.

The rings 42 have quite short axial lengths so that none of them simultaneously acts as a support for two or more adjacent cores 26. In this embodiment, in fact, the opposite occurs, that is, the same core 26 bears on several different rings 42, as can be seen in FIG. 4.

Each core 26 is thus engaged on the shaft 24 independently of the others. In particular, if the radial dimensions of the cut roll portions 28 wound on the same shaft 24 increase differently because of anomalous variations in the thickness of the strip 20 of the original roll 16 along its width, the various cores 26 slide differently relative to the rings 42 of the portion of shaft 24 around which they are fitted, respectively.

For example, if the radius of one of the rolls 28 increases more than that of the others, more sliding takes place between its core 26 and the rings 42 on which it bears, slowing its angular velocity.

The tangential rewinding speed which is given by the product of the angular velocity and the radius of each roll 28 is thus kept constant at all times for the various rolls 28 associated with the same shaft 24.

It is therefore possible to select the torque imparted to each shaft 24 so as to achieve a tangential velocity which is equal at all times for all of the rolls 28 rewound on the same shaft 24 and which is associated with the optimal tension in the various strip portions 20 rewound.

This prevents the problems connected with too loose or too tight a rewinding of the rolls 28 which would be caused by incorrect rewinding tensions.

Naturally, the principle of the invention remaining the same, the details of construction and forms of embodiment may be varied widely with respect to those described and illustrated, purely by way of example, without thereby departing from the scope thereof.

In particular, the axial length of each ring 42, and hence the number of rings for a given length of shaft 24, may be selected taking into account that at least one ring 42 is required for each roll portion 28. Naturally, the larger the number of rings 42 selected, the greater will be the flexibility of use of the shaft 24 enabling up to an approximately corresponding number of rolls 28 to be rewound.

What is claimed is:

1. A shaft (24) for supporting cut roll portions (28) in a cutting-reeling machine (10) comprising a cylindrical body (30) having a longitudinal axis and an outer surface having at least one recess (34) for housing a resilient envelope (36) which can be connected to a source of fluid under pressure by ducts (38, 40) in the cylindrical body (30), a plurality of rings (42) open along respective generatrices (44), arranged side by side around the outer surface of the body (30) and coaxial with the longitudinal axis of the shaft (24), the rings (42) having means for engagement with the body (30) of the shaft (24) which allow the rings to expand circumferentially upon inflation of the resilient envelope (36) into direct contact with said rings.

2. A shaft (24) according to claim 1, wherein each ring (42) has edges (46) which are turned over radially towards the axis of the shaft (24) along the open generatrix (44) and which can engage with clearance in a groove (32) formed in the outer surface of the shaft (24) parallel to said longitudinal axis.

3. A shaft (24) according to claim 2, wherein outer surface of the body (30) has a plurality of uniformly-spaced longitudinal grooves (32) alternating with longitudinal recesses (34) formed in the outer surface of the shaft (24) parallel to said axis for housing respective resilient envelopes (36).

4. A shaft (24) according to claim 3, wherein each resilient envelope (36) is connected, by a respective radial duct (38) formed in the cylindrical body (30), to a duct (40) coaxial with the axis of the shaft (24) and connectible to a source of fluid under pressure.

5. A shaft (24) according to claim 2, wherein the rings (42) are made of metal.

6. A shaft according to claim 2, wherein the rings are made of steel.

* * * * *